US010185344B1

(12) United States Patent
Kadanka

(10) Patent No.: US 10,185,344 B1
(45) Date of Patent: Jan. 22, 2019

(54) COMPENSATION OF INPUT CURRENT OF LDO OUTPUT STAGE

(71) Applicant: SEMICONDUCTOR COMPONENTS INDUSTRIES, LLC, Phoenix, AZ (US)

(72) Inventor: Petr Kadanka, Valasska Bystrice (CZ)

(73) Assignee: Semiconductor Components Industries, LLC, Phoenix, AZ (US)

( * ) Notice: Subject to any disclaimer, the term of this patent is extended or adjusted under 35 U.S.C. 154(b) by 0 days.

(21) Appl. No.: 15/995,441

(22) Filed: Jun. 1, 2018

(51) Int. Cl.
*G05F 1/575* (2006.01)
*G05F 3/24* (2006.01)

(52) U.S. Cl.
CPC ..... *G05F 1/575* (2013.01); *G05F 3/247* (2013.01)

(58) Field of Classification Search
CPC . G05F 1/46; G05F 1/461; G05F 1/462; G05F 1/467; G05F 1/56; G05F 1/561; G05F 1/565; G05F 1/575
See application file for complete search history.

(56) References Cited

U.S. PATENT DOCUMENTS 5,188,211 A 2/1993 Ringot-Mora et al.
7,218,082 B2 5/2007 Walter et al.
7,956,679 B2 * 6/2011 Kimura ..... H03F 3/45179 330/257
8,179,108 B2 * 5/2012 Kimura ..... G05F 1/575 323/280
9,468,048 B2 10/2016 Eom et al.
9,563,223 B2 2/2017 Bai et al.

* cited by examiner

*Primary Examiner* — Gary L Laxton
(74) *Attorney, Agent, or Firm* — Brake Hughes Bellermann LLP

(57) ABSTRACT

According to an aspect, a low-dropout (LDO) regulator includes a pre-charge buffer, an output stage, and a noise filter connected between the pre-charge buffer and the output stage of the LDO regulator. The noise filter includes a first resistor. The LDO regulator includes a transistor configured as an input to the output stage, and a compensation circuit connected to an input of the pre-charge buffer. The compensation circuit includes a second resistor. The compensation circuit is configured to provide a compensation current that produces a first voltage drop across the second resistor, where the first voltage drop offsets a second voltage drop produced by an input current of the transistor across the first resistor.

20 Claims, 6 Drawing Sheets

COMPENSATION OF INPUT CURRENT OF LDO OUTPUT STAGE

TECHNICAL FIELD

This description relates to compensation of input current of an output stage in a low dropout (LDO) regulator.

BACKGROUND

An LDO regulator is a direct current (DC) linear voltage regulator that regulates the output voltage even when the supply voltage is close to the output voltage. In some LDO regulators, the output voltage can be affected in an undesirable fashion by voltage drops across components included in the LDO regulator.

SUMMARY

According to an aspect, a low-dropout (LDO) regulator includes a pre-charge buffer, an output stage, and a noise filter connected between the pre-charge buffer and the output stage of the LDO regulator. The noise filter includes a first resistor. The LDO regulator includes a transistor configured as an input to the output stage, and a compensation circuit connected to an input of the pre-charge buffer. The compensation circuit includes a second resistor. The compensation circuit is configured to provide a compensation current that produces a first voltage drop across the second resistor, where the first voltage drop offsets a second voltage drop produced by an input current of the transistor across the first resistor.

According to some aspects, the LDO regulator may include one or more of the following features (or any combination thereof). The transistor is a bipolar junction transistor (BJT). The compensation current is the same as the input current of the transistor. The second resistor has a resistor value that is the same as a resistor value of the first resistor. The input of the pre-charge buffer is a first input, and the pre-charge buffer includes a second input configured to receive a reference voltage. The compensation circuit includes a transistor connected to the second resistor, where the compensation current is an input current of the transistor of the compensation circuit. The transistor of the compensation circuit is a bipolar junction transistor (BJT). The first voltage drop is the same as the second voltage drop. The output stage includes a voltage amplifier having an input, and the input of the voltage amplifier is connected to the transistor.

According to an aspect, a LDO regulator includes a voltage reference generator configured to generate a reference voltage, and a pre-charge buffer having a first input and a second input, where the first input is configured to receive the reference voltage. The LDO regulator includes an output stage, and a noise filter connected between the pre-charge buffer and the output stage of the LDO regulator. The noise filter includes a first resistor and a capacitor. The LDO regulator includes a transistor configured as an input to the output stage, and a compensation circuit connected to the second input of the pre-charge buffer. The compensation circuit includes a second resistor. The compensation circuit is configured to provide a compensation current that produces a first voltage drop across the second resistor, where the first voltage drop offsets a second voltage drop produced by an input current of the transistor across the first resistor. The output stage is configured to generate an output voltage that is substantially the same as the reference voltage.

According to some aspects, the LDO regulator may include one or more of the following features (or any combination thereof). The transistor is a bipolar junction transistor (BJT). The compensation current is the same as the input current of the transistor, and the second resistor has a resistor value that is the same as a resistor value of the first resistor. The compensation circuit includes a transistor and a current mirror. The current mirror configured to mirror the input current of the transistor and provide the mirrored input current as an input current of the transistor of the compensation circuit, where the input current of the transistor of the compensation circuit is the compensation current. The output stage includes a voltage amplifier and a transistor. The LDO regulator includes a first switch connected to the first resistor, a second switch connected to the second resistor, and a pre-charge timer configured to control an opening and closing of the first switch and the second switch in response to an enable signal. The first voltage drop is the same as the second voltage drop. The LDO regulator includes a transistor connected to an output of the pre-charge buffer, and the transistor is connected to a node disposed between the first resistor and the second resistor. The compensation circuit includes a transistor connected to the second resistor, where the compensation current is an input current of the transistor of the compensation circuit.

According to an aspect, a method of improving a performance of low-dropout (LDO) regulator includes filtering noise from a reference voltage using a noise filter connected between a pre-charge buffer and an output stage of the LDO regulator, where the noise filter has a first resistor, and an input of the pre-charge buffer is connected to a transistor, providing, by a compensation circuit having a second resistor, a compensation current to produce a first voltage drop across the second resistor, where the first voltage drop offsets a second voltage drop produced by an input current of the transistor across the first resistor, and generating an output voltage as a function of the reference voltage.

The details of one or more implementations are set forth in the accompanying drawings and the description below. Other features will be apparent from the description and drawings, and from the claims.

DETAILED DESCRIPTION

The present disclosure relates to an LDO regulator having a compensation circuit configured to offset, for example, a voltage drop of a noise filter caused by the input current of a bipolar junction transistor (BJT) of an output stage of the LDO regulator by providing an equal voltage drop on the input of a pre-charge buffer of the LDO regulator. In some examples, in contrast to some conventional approaches, the compensation circuit is configured to compensate the influence of the input current of the output stage BJT input even if the BJT input of the output stage is only a few mV below the supply voltage. The configuration of the compensation circuit may allow a high value resistor in the noise filter, which may improve the noise performance of the LDO regulator.

Figure 1:
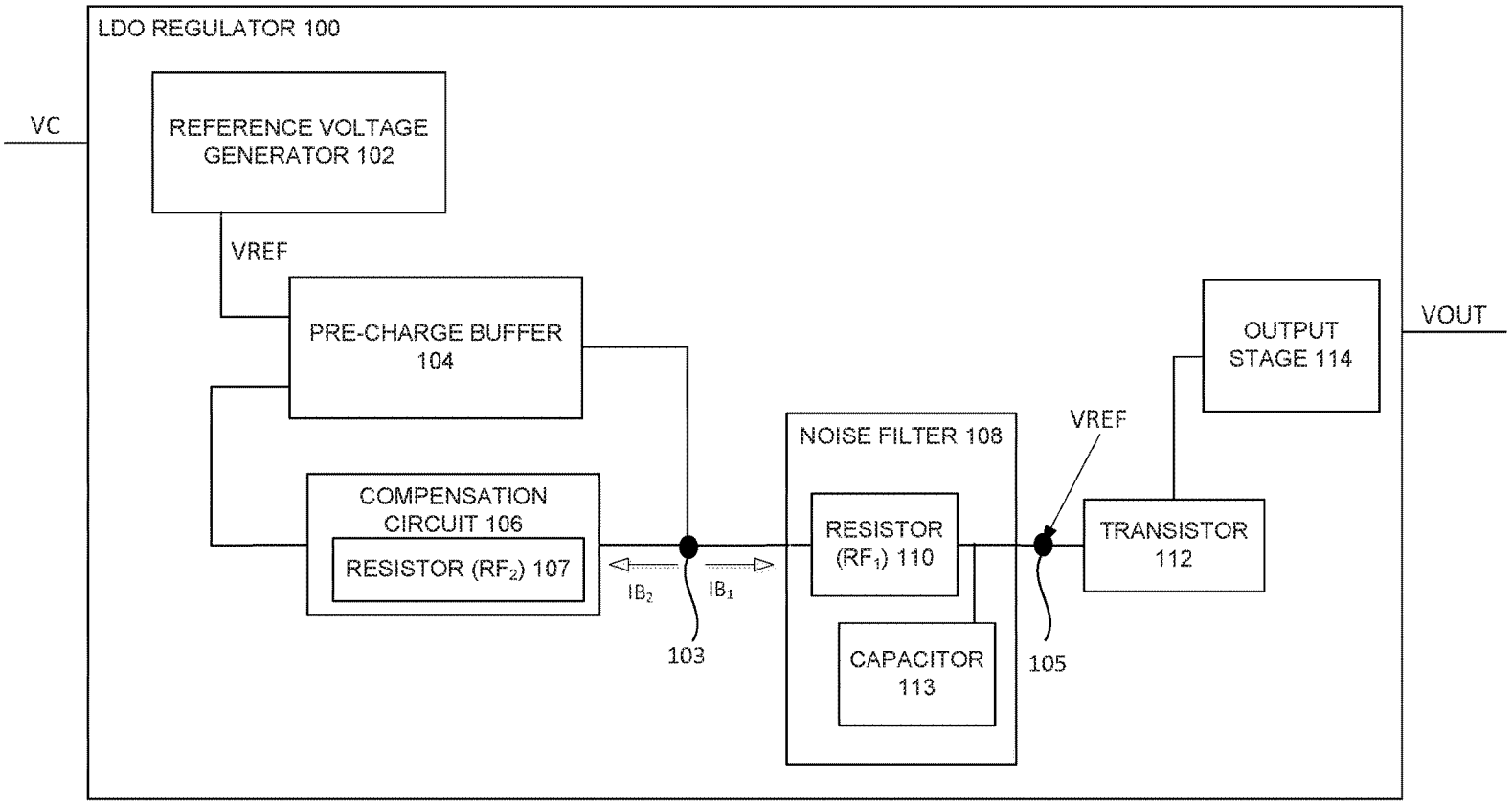
FIG. 1 illustrates an LDO regulator having a compensation circuit configured to offset an input current of a transistor configured as an input to an output stage according to an aspect.

FIG. 1 illustrates an LDO regulator 100 having a compensation circuit 106 configured to offset an input current $IB_1$ of a transistor 112 configured as an input to an output stage 114 according to an aspect. The compensation circuit 106 is configured to produce a compensation current $IB_2$ that offsets the input current $IB_1$, thereby improving the noise performance of the LDO regulator 100. In some examples, the compensation current $IB_2$ is the same as the input current $IB_1$. In some examples, the compensation current $IB_2$ is the same as the input current $IB_1$ under most (or all) conditions such as different temperatures, during start-up, etc. In some examples, the input current $IB_1$ is not eliminated, but is offset by the compensation current $IB_2$.

The LDO regulator 100 is configured to generate and maintain an output voltage VOUT from a supply voltage VC. The LDO regulator 100 also includes a reference voltage generator 102 configured to generate a reference voltage VREF, a pre-charge buffer 104, and a noise filter 108. The reference voltage VREF may be equal to the output voltage VOUT. For example, the level of the reference voltage VREF determines the level of the output voltage VOUT.

The pre-charge buffer 104 may be a voltage follower having a first input configured to receive the reference voltage VREF from the reference voltage generator 102, and a second input connected to the compensation circuit 106, which receives the output of the pre-charge buffer 104. In some examples, the second input (that is connected to the compensation circuit 106) is an inverting input of the pre-charge buffer 104. The output of the pre-charge buffer 104 is connected to the second input of pre-charge buffer 104 via the compensation circuit 106. For example, the output of the pre-charge buffer 104 is connected to a node 103, and the compensation circuit 106 is disposed within the circuit path between the node 103 and the second input of the pre-charge buffer.

The noise filter 108 is connected between the pre-charge buffer 104 and the output stage 114. For example, the noise filter 108 is connected to, and disposed between, the node 103 and the transistor 112 configured as the input to the output stage 114. The noise filter 108 may reduce or remove the noise from the reference voltage VREF. The noise filter 108 may include a resistor ($RF_1$) 110 and a capacitor 113.

The transistor 112 is configured as the input to the output stage 114. In some examples, the transistor 112 is a BJT. In some examples, the transistor 112 is an NPN BJT. In some examples, the base of the transistor 112 is connected to the output of the noise filter 108, and the collector of the transistor 112 is connected to the output stage 114. In some examples, the output stage 114 includes an amplifier or buffer and/or a one or more transistors (e.g., MOSFET, FET, etc.).

The input current $IB_1$ of the transistor 112 flows through the resistor ($RF_1$) 110 of the noise filter 108. The DC voltage drop across the resistor ($RF_1$) 110 of the noise filter 108 (e.g., between the node 103 and a node 105) may effect the reference voltage VREF, and consequently the output voltage VOUT of the LDO regulator 100. For example, the voltage at the node 105 should be the reference voltage VREF. However, the voltage drop across the resistor ($RF_1$) 110 may negatively affect the performance of the LDO regulator 100 because the voltage at the node 105 may be different from the reference voltage VREF. In some conventional approaches, the LDO regulator 100 may attempt to eliminate the input current $IB_1$ of the transistor 112, but, in these conventional approaches, the output voltage VOUT may vary from the reference voltage VREF for voltages VREF approaching the supply voltage, thereby affecting the performance of the LDO regulator 100.

However, the compensation circuit 106 is configured to offset the voltage drop across the resistor ($RF_1$) 110 of the noise filter 108 by creating an equal voltage drop on the feedback loop of the pre-charge buffer 104 that offsets the voltage drop across the resistor ($RF_1$) 110. For example, the compensation circuit 106 may include a resistor ($RF_2$) 107. The value of the resistor ($RF_2$) 107 may be the same as the value of the resistor ($RF_1$) 110. The compensation circuit 106 is configured to create the current $IB_2$ (that matches the current $IB_1$), which provides an equal voltage drop on the feedback path of the pre-charge buffer 104 in order to compensate for the voltage drop across the resistor ($RF_1$) 110 of the noise filter 108. For example, the compensation circuit 106 is configured to provide a voltage drop $IB_2*RF_2$ that offsets the voltage drop $IB_1*RF_1$ in order to provide the reference voltage VREF at the base of the transistor 112 or the node 105.

Figure 2A:
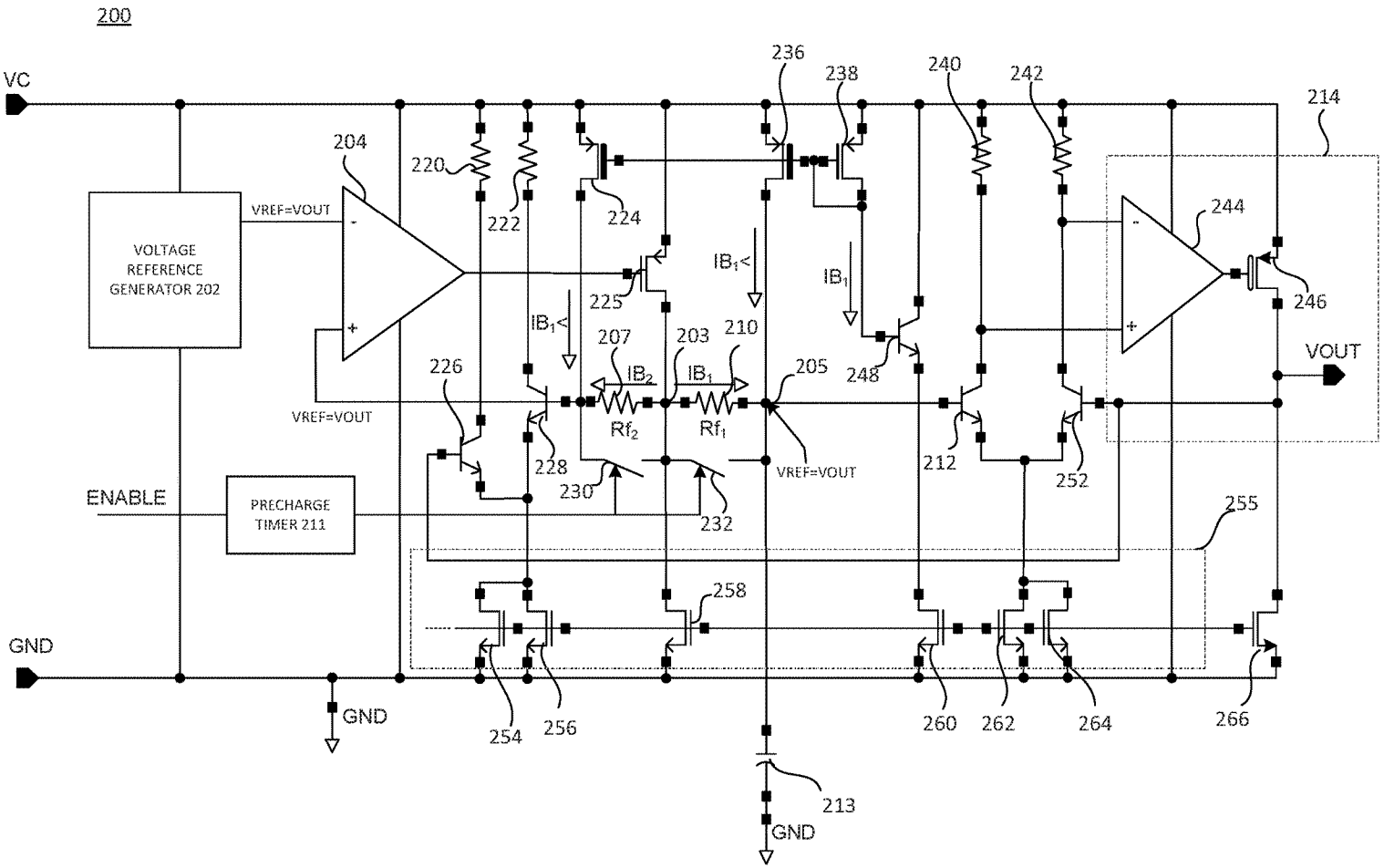
FIG. 2A illustrates an LDO regulator having a compensation circuit according to another aspect.
Figure 2B:
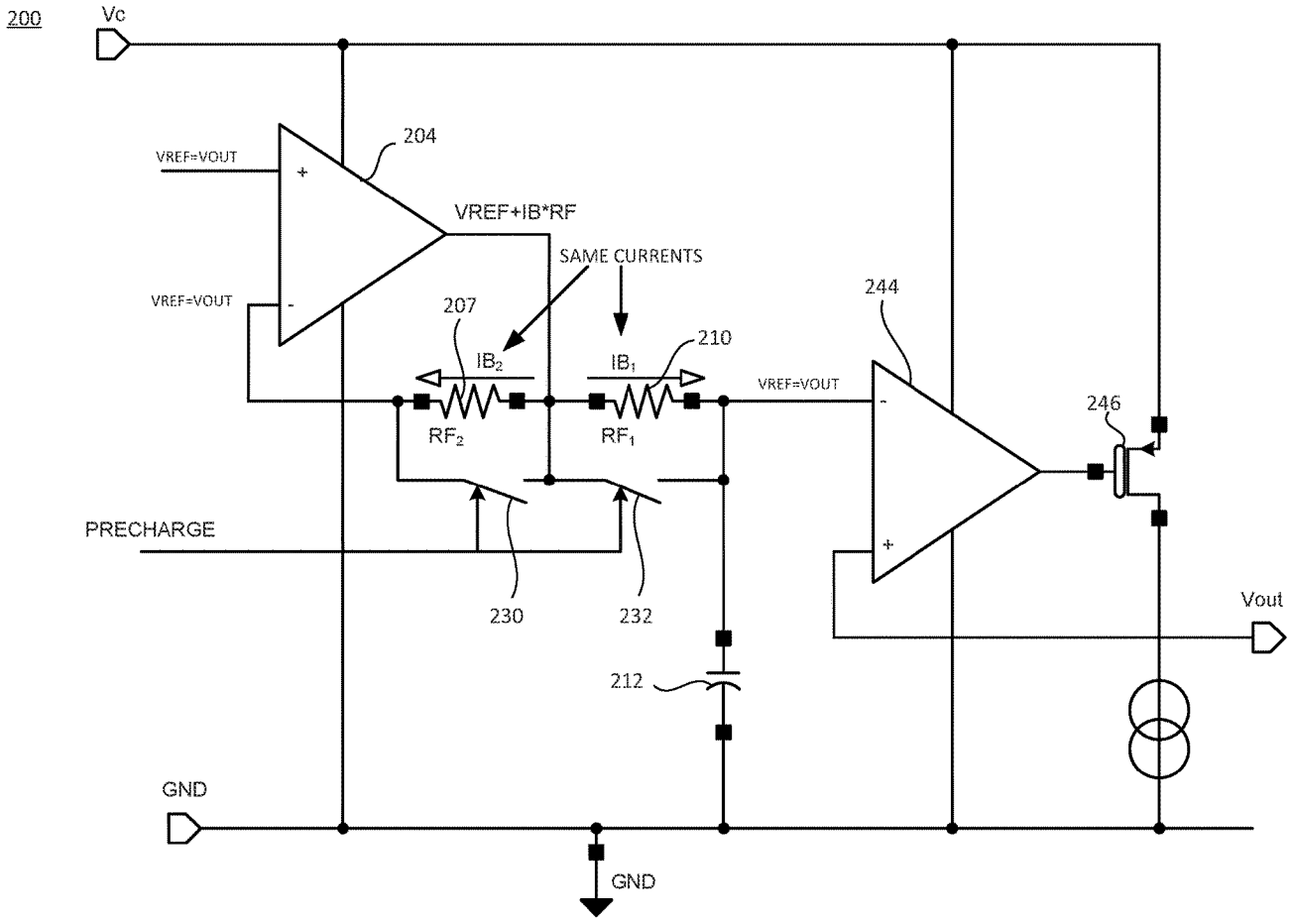
FIG. 2B illustrates the LDO regulator of FIG. 2A according to an aspect.

FIGS. 2A and 2B illustrate an LDO regulator 200 according to another aspect. FIG. 2B illustrates a simplified view of the LDO regulator 200 of FIG. 2A. The LDO regulator 200 may be an example of the LDO regulator 100 of FIG. 1, and may include any of the features described with reference to FIG. 1. The LDO regulator 200 includes a voltage reference generator 202, a pre-charge buffer 204, and an output stage 214 having a voltage amplifier 244 and a transistor 246. The transistor 246 may be a P-channel transistor. The voltage reference generator 202 may be an example of the reference voltage generator 102 of FIG. 1. The pre-charge buffer 204 may be an example of the pre-charge buffer 104 of FIG. 1. The output stage 214 may be an example of the output stage 114 of FIG. 1.

The LDO regulator 200 includes a transistor 212 configured as an input to the output stage 214. The transistor 212 may be an example of the transistor 112 of FIG. 1. In some examples, the transistor 212 is a BJT. In some examples, the transistor 212 is a NPN BJT. The LDO regulator 200 includes a resistor 210 and a capacitor 213, which, collectively, define a noise filter (e.g., the noise filter 108 of FIG. 1).

The LDO regulator 200 includes a resistor 207, a transistor 226, a transistor 228, a current mirror 255, a resistor 220, and a resistor 222, which, collectively, define a compensation circuit (e.g., the compensation circuit 106 of FIG. 1). The current mirror 255 includes a transistor 254, a transistor 256, a transistor 258, a transistor 260, a transistor 262, and a transistor 264. In some examples, the transistor 226 is an NPN BJT. In some examples, the transistor 228 is an NPN BJT. The resistor 207 may be an example of the resistor 107 of FIG. 1. In some examples, the transistor 226 is an NPN BJT. In some examples, the transistor 228 is an NPN BJT.

The LDO regulator 200 includes a pre-charge timer 211 configured to control the opening and closing of a first switch 230 and a second switch 232 in response to a signal ENABLE. For example, during a first period, the first switch 230 and the second switch 232 are closed, and during a second period, the first switch 230 and the second switch 232 are open, thereby shorting the resistor 207 and the resistor 210.

The base current $IB_1$ of the transistor 212 is not eliminated, but its influence is compensated by the same value current (e.g., $IB_2$) flowing through the resistor 207 (e.g., $Rf_2=Rf_1$) that is connected to the input of the pre-charge buffer 204. Then, a correct voltage (VOUT=VREF) is provided on the input of the output stage 214 (e.g., at the base of the transistor 212). The compensation current $IB_2$ is created as the base current of the transistor 228 (that is identical to the transistor 212) with the same current that is provided by the transistor 254 and the transistor 256 that is identical to the current of the transistor 262 and the transistor 264. The compensation may be correctly applied even if the supply voltage VC is very close to VREF=VOUT.

The voltage reference generator 202 and the pre-charge buffer 204 are connected to the supply voltage VC and the ground GND. The pre-charge buffer 204 includes a first input connected to and configured to receive the reference voltage VREF from the voltage reference generator 202, and a second input is configured to receive the feedback voltage which is the reference voltage VREF. The reference voltage VREF may be equal to the output voltage VOUT at the first input and the second input of the pre-charge buffer 204. In some examples, the second input of the pre-charge buffer 204 is connected to the base of the transistor 228 and the first terminal of the resistor 207. The second terminal of the resistor 207 is connected to a node 203. The node 203 may be an example of the node 103 of FIG. 1.

The output of the pre-charge buffer 204 is connected to a gate of a transistor 225. In some examples, the transistor 225 is a P-channel transistor. The source of the transistor 225 is connected to the supply voltage VC, and the drain of the transistor 225 is connected to the node 203. The resistor 210 has a first terminal connected to the node 203, and a second terminal connected to a node 205. The node 205 may be an example of the node 105 of FIG. 1. The capacitor 213 has a first terminal connected to the node 205 and a second terminal connected to the ground GND. The resistor 210 and the capacitor 213 may be referred to as an RC filter that filters the noise of the reference voltage VREF.

The transistor 212 and a transistor 252 may function as inputs to the output stage 214 or as inputs to the first and second inputs of the voltage amplifier 244. In some examples, the transistor 252 is an NPN BJT. The base of the transistor 212 is connected to the node 205. The collector of the transistor 212 is connected to the first input of the voltage amplifier 244 and to a first terminal of a resistor 240. A second terminal of the resistor 240 is connected to the supply voltage VC. The emitter of the transistor 212 is connected to the emitter of a transistor 252, and the emitters of the transistor 212 and the transistor 252 are connected to the current mirror 255 so that compensation current $IB_2$ can have the same value as the input current $IB_1$. The collector of the transistor 252 is connected to the second input of the voltage amplifier 244 and a first terminal of a resistor 242, and the base of the transistor 252 is connected to output voltage VOUT, e.g., the drain of the transistor 246. A second terminal of the resistor 242 is connected to the supply voltage VC. The output of the voltage amplifier 244 is connected to the gate of the transistor 246. The source of the transistor 246 is connected to the supply voltage VC. The drain of transistor 246 may be connected to the drain of transistor 266. In some examples, the transistor 266 is an N-channel transistor. The gate of the transistor 266 is connected to the current mirror 255, and the source of the transistor 266 is connected to the ground GND.

As discussed herein, the input current $IB_1$ of the base of the transistor 212 causes a voltage drop across the resistor 210, which can cause the voltage reference VREF to be not equal to the output voltage VOUT at the node 205. However, the LDO regulator 200 compensates the input current $IB_1$ by providing the compensation current $IB_2$, which causes a voltage drop across the resistor 207. Since the compensation current $IB_2$ is equal to the input current $IB_1$ and the values $RF_1$ and $RF_2$ are the same, the voltage drop across the resistor 207 is the same as the voltage drop across the resistor 210, thereby providing VREF=VOUT on the node 205.

For example, the resistor 220, the resistor 222, the transistor 226, and the transistor 228 may correspond to a similar arrangement of the resistor 240, the resistor 242, the transistor 212, and the transistor 252 at the input side of the output stage 214. In other words, in order to provide the same current as the input current $IB_1$ at the input of the base of the transistor 228, the resistor 220, the resistor 222, the transistor 226, and the transistor 228 are arranged in a similar arrangement to the resistor 240, the resistor 242, the transistor 212, and the transistor 252 at the input side of the output stage 214.

For example, the emitter of the transistor 226 is connected to the emitter of the transistor 228, and the emitters of the transistor 226 and the transistor 228 are connected to the current mirror 255. The collector of the transistor 226 is connected to a first terminal of the resistor 220, and the base of the transistor 226 is connected to the base of the transistor 252. A second terminal of the resistor 220 is connected to the supply voltage VC. The collector of the transistor 228 is connected to a first terminal of the resistor 222. A second terminal of the resistor 222 is connected to the supply voltage VC. The base of the transistor 228 is connected to a first terminal of the resistor 207, and the base of the transistor 228 is connected to the second input of the pre-charge buffer 204. The second terminal of the resistor 207 is connected to the node 203. The differential arrangement of the transistor 226 and the transistor 228 in match with the transistor 212 and the transistor 252 may assure identical base currents of the transistor 228 and the transistor 212 at any condition.

The LDO regulator 200 also includes a transistor 224, a transistor 236, and a transistor 238, and a transistor 248. In some examples, the transistor 224, the transistor 236, and the transistor 238 are P-channel transistors. In some examples, the transistor 248 is an NPN BJT. The source of the transistor 224 is connected to the supply voltage VC, and the drain of the transistor 224 is connected to the first terminal of the resistor 207. The drain of the transistor 224 is configured to provide a compensation current that is greater than the input current $IB_1$ (and $IB_2$ since $IB_2$ is equal to $IB_1$). The transistor 224, the transistor 236, and the transistor 238 are connected in a current mirror arrangement. The source of the transistor 236 is connected to the supply voltage VC, and the drain of the transistor 236 is connected to the node 205. The drain of the transistor 236 is configured to provide a compensation current that is greater than the input current $IB_1$ (and $IB_2$ since $IB_2$ is equal to $IB_1$). The source of the transistor 238 is connected to the supply voltage VC, and the drain of the transistor 238 is connected to the base of the transistor 248. The base of the transistor 248 is connected to the transistor 238, and the base of the transistor 248 is configured to receive a current that equals the input current $IB_1$. The collector of the transistor 248 is connected to the supply voltage VC, and the emitter of the transistor 248 is connected to the current mirror 255.

It is noted that the voltage on the drain of the transistor 225 (e.g., at the node 203) may be $IB_1*RF_1$ higher compare to the VREF=VOUT, which can be an issue if low beta transistors are used, and the $IB_1*RF_1$ voltage drop may negatively effect performance of the LDO regulator 200 (e.g., $IB_1*RF_1$ can be higher than dropout). However, the compensation currents (the drain currents of the transistor 236 and the transistor 224) are derived from the base current of the transistor 248 (with current identical to the base currents of the transistor 228 and the transistor 212. The compensation currents can be higher than $IB_1$. Then, the voltage on the drain of the transistor 225 is lower than VREF=VOUT. This is not an issue because there is sufficient space between the drain of the transistor 225 and the ground GND. In some examples, there is no requirement for the drain currents of the transistor 224 and the transistor 236 to be identical to the drain current of the transistor 238. However, the drain current of the transistor 224 is equal to the drain current of the transistor 236, which is maintained by a matching the transistor 236 and the transistor 224 and by the same condition (voltage) on the drains of the transistor 224 and the transistor 236.

Figure 3:
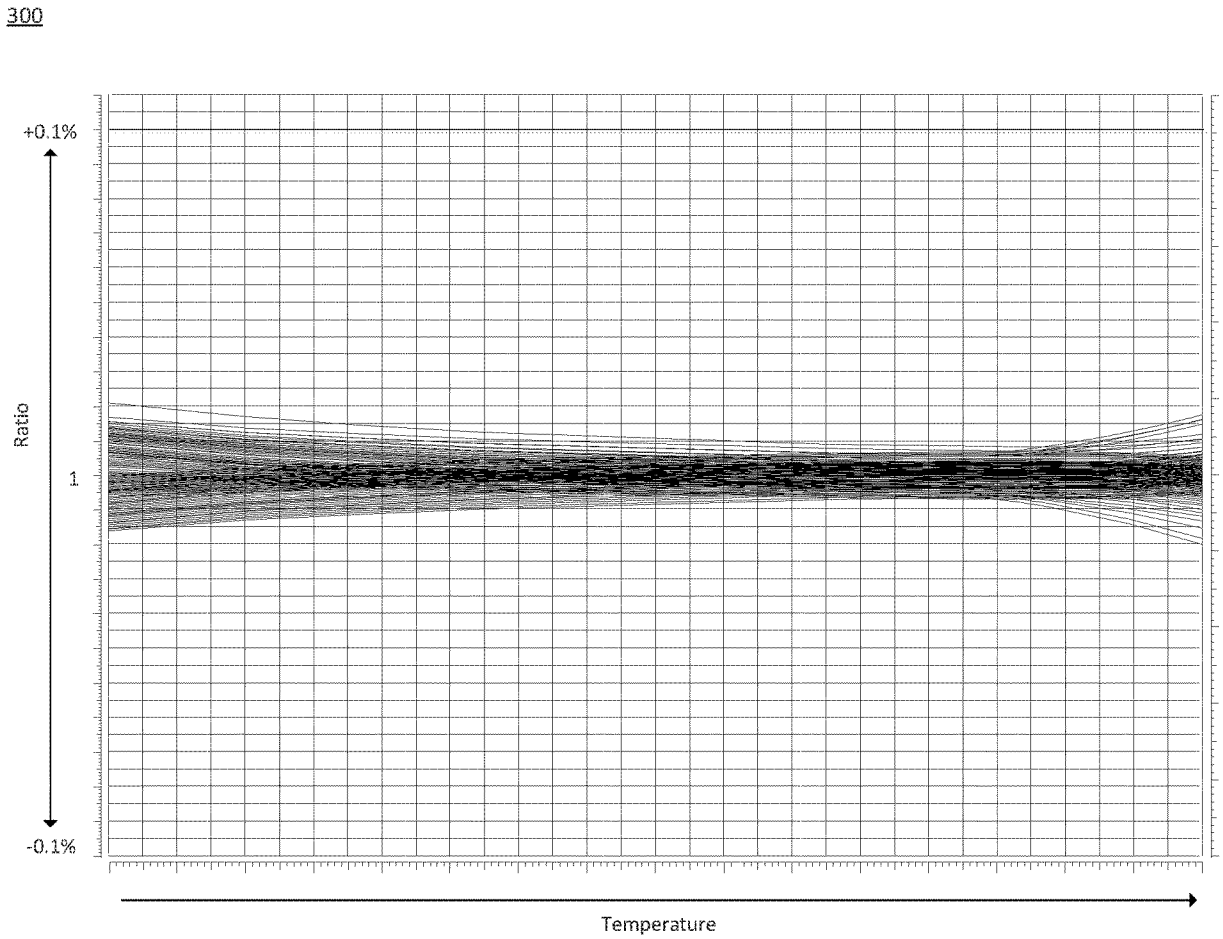
FIG. 3 illustrates a graph depicting results of a temperature sweep of a Monte Carlo simulation according to an aspect.
Figure 4:
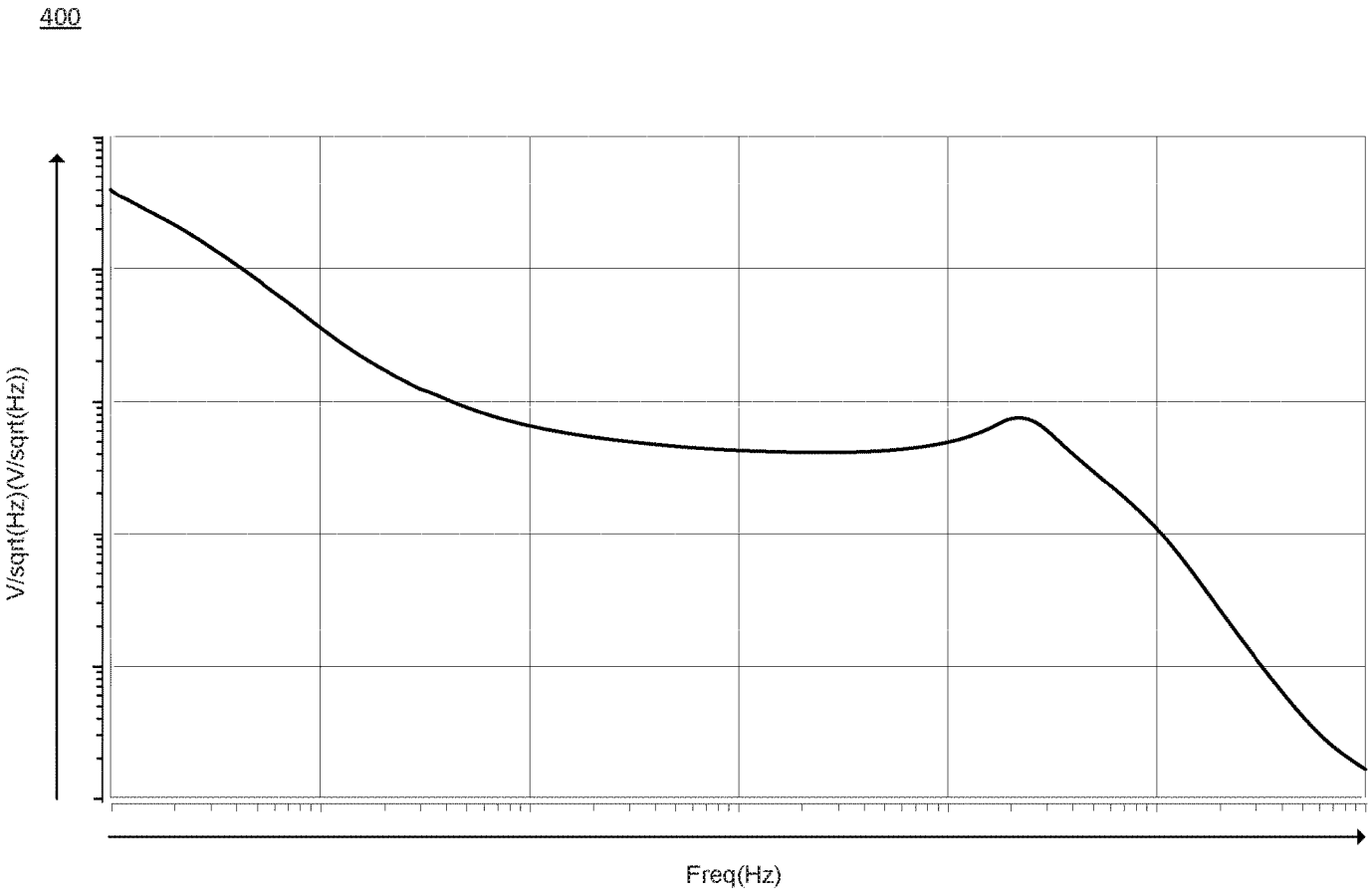
FIG. 4 illustrates a graph depicting a noise spectrum of an LDO regulator according to an aspect.

FIG. 3 illustrates a graph 300 depicting results of a temperature sweep of a Monte Carlo simulation according to an aspect. The graph 300 depicts the change in ratio of the voltage on the input of the pre-charge buffer 204 and the voltage on the base of the transistor 212 with respect to increasing temperature, which shows that the mismatch between the voltage on the input of the pre-charge buffer 204 and the voltage on the base of the transistor 212 is relatively small. FIG. 4 illustrates a graph 400 depicting a noise spectrum of the LDO regulator 200 according to an aspect. As shown in FIG. 4, the noise response of the LDO regulator 200 is relatively low.

Figure 5:
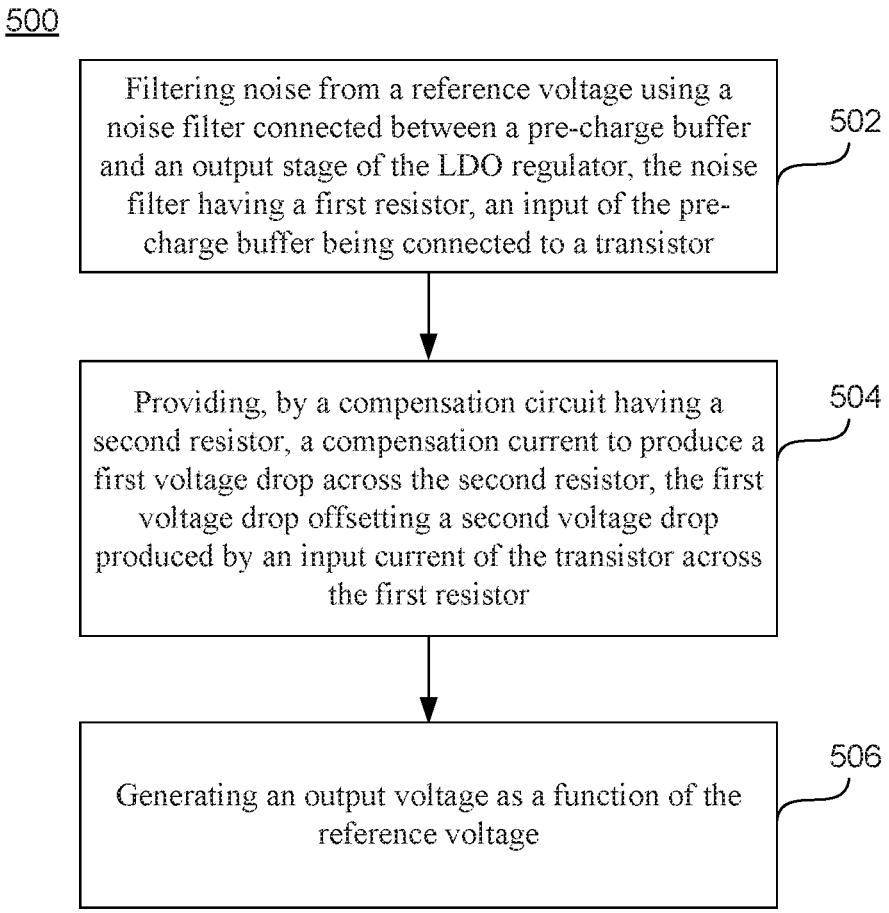
FIG. 5 illustrates a flowchart depicting example operations of an LDO regulator according to an aspect.

FIG. 5 illustrates a flowchart 500 depicting example operations of an LDO regulator according to an aspect. Although the flowchart 500 of FIG. 5 illustrates operations in sequential order, it will be appreciated that this is merely an example, and that additional or alternative operations may be included. Further, operations of FIG. 5 and related operations may be executed in a different order than that shown, or in a parallel or overlapping fashion. The operations of FIG. 5 may be performed by any of the LDO regulators discussed herein.

Operation 502 includes filtering noise from a reference voltage using a noise filter connected between a pre-charge buffer and an output stage of the LDO regulator, where the noise filter has a first resistor, and an input of the pre-charge buffer is connected to a transistor.

Operation 504 includes providing, by a compensation circuit having a second resistor, a compensation current to produce a first voltage drop across the second resistor, where the first voltage drop offsets a second voltage drop produced by an input current of the transistor across the first resistor.

Operation 506 includes generating an output voltage as a function of the reference voltage.

It will be understood that, in the foregoing description, when an element is referred to as being connected to, electrically connected to, coupled to, or electrically coupled to another element, it may be directly connected or coupled to the other element, or one or more intervening elements may be present. In contrast, when an element is referred to as being directly connected to or directly coupled to another element, there are no intervening elements. Although the terms directly connected to, or directly coupled to may not be used throughout the detailed description, elements that are shown as being directly connected or directly coupled can be referred to as such. The claims of the application, if any, may be amended to recite exemplary relationships described in the specification or shown in the figures. Implementations of the various techniques described herein may be implemented in (e.g., included in) digital electronic circuitry, or in computer hardware, firmware, software, or in combinations of them. Portions of methods also may be performed by, and an apparatus may be implemented as, special purpose logic circuitry, e.g., an FPGA (field programmable gate array) or an ASIC (application specific integrated circuit).

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments. It should be understood that they have been presented by way of example only, not limitation, and various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described.

What is claimed is:

1. A low-dropout (LDO) regulator comprising:

a pre-charge buffer;

an output stage;

a noise filter connected between the pre-charge buffer and the output stage of the LDO regulator, the noise filter including a first resistor;

a transistor configured as an input to the output stage; and a compensation circuit connected to an input of the pre-charge buffer, the compensation circuit including a second resistor, the compensation circuit configured to provide a compensation current that produces a first voltage drop across the second resistor, the first voltage drop offsetting a second voltage drop produced by an input current of the transistor across the first resistor.

2. The LDO regulator of claim 1, wherein the transistor is a bipolar junction transistor (BJT).

3. The LDO regulator of claim 1, wherein the compensation current is the same as the input current of the transistor.

4. The LDO regulator of claim 1, wherein the second resistor has a resistor value that is the same as a resistor value of the first resistor.

5. The LDO regulator of claim 1, wherein the input of the pre-charge buffer is a first input, the pre-charge buffer including a second input configured to receive a reference voltage.

6. The LDO regulator of claim 1, wherein the compensation circuit includes a transistor connected to the second resistor, wherein the compensation current is an input current of the transistor of the compensation circuit.

7. The LDO regulator of claim 6, wherein the transistor of the compensation circuit is a bipolar junction transistor (BJT).

8. The LDO regulator of claim 1, wherein the first voltage drop is the same as the second voltage drop.

9. The LDO regulator of claim 1, wherein the output stage includes a voltage amplifier having an input, the input of the voltage amplifier being connected to the transistor.

10. A low-dropout (LDO) regulator comprising:

a voltage reference generator configured to generate a reference voltage;

a pre-charge buffer having a first input and a second input, the first input configured to receive the reference voltage;

an output stage;

a noise filter connected between the pre-charge buffer and the output stage of the LDO regulator, the noise filter including a first resistor and a capacitor;

a transistor configured as an input to the output stage; and a compensation circuit connected to the second input of the pre-charge buffer, the compensation circuit including a second resistor, the compensation circuit configured to provide a compensation current that produces a first voltage drop across the second resistor, the first voltage drop offsetting a second voltage drop produced by an input current of the transistor across the first resistor, the output stage configured to generate an output voltage that is substantially the same as the reference voltage.

11. The LDO regulator of claim 10, wherein the transistor is a bipolar junction transistor (BJT).

12. The LDO regulator of claim 10, wherein the compensation current is the same as the input current of the transistor, and the second resistor has a resistor value that is the same as a resistor value of the first resistor.

13. The LDO regulator of claim 10, wherein the compensation circuit includes a transistor and a current mirror, the current mirror configured to mirror the input current of the transistor and provide the mirrored input current as an input current of the transistor of the compensation circuit, the input current of the transistor of the compensation circuit being the compensation current.

14. The LDO regulator of claim 10, wherein the output stage includes a voltage amplifier and a transistor.

15. The LDO regulator of claim 10, further comprising:

a first switch connected to the first resistor;

a second switch connected to the second resistor; and a pre-charge timer configured to control an opening and closing of the first switch and the second switch in response to an enable signal.

16. The LDO regulator of claim 10, wherein the first voltage drop is the same as the second voltage drop.

17. The LDO regulator of claim 10, further comprising:

a transistor connected to an output of the pre-charge buffer, the transistor being connected to a node disposed between the first resistor and the second resistor.

18. The LDO regulator of claim 10, wherein the compensation circuit includes a transistor connected to the second resistor, wherein the compensation current is an input current of the transistor of the compensation circuit.

19. A method of improving a performance of low-dropout (LDO) regulator, the method comprising:

filtering noise from a reference voltage using a noise filter connected between a pre-charge buffer and an output stage of the LDO regulator, the noise filter having a first resistor, an input of the pre-charge buffer being connected to a transistor;

providing, by a compensation circuit having a second resistor, a compensation current to produce a first voltage drop across the second resistor, the first voltage drop offsetting a second voltage drop produced by an input current of the transistor across the first resistor; and generating an output voltage as a function of the reference voltage.

20. The method of claim 19, wherein the first voltage drop is the same as the second voltage drop.

* * * * *